United States Patent [19]

VanHorne

[11] Patent Number: 4,567,081

[45] Date of Patent: Jan. 28, 1986

[54] SEPARATOR SHEETS FOR COLLATION WITH A STACK OF TRANSPARENCIES

[75] Inventor: Arthur C. VanHorne, Lake Oswego, Oreg.

[73] Assignee: Tektronix, Inc., Beaverton, Oreg.

[21] Appl. No.: 631,970

[22] Filed: Jul. 18, 1984

[51] Int. Cl.[4] ..... B32B 3/24; B32B 5/18

[52] U.S. Cl. ..... 428/138; 206/412; 206/449; 206/454; 271/1; 271/90; 428/311.1

[58] Field of Search ..... 271/90, 1; 206/454, 206/449, 412; 428/131, 138, 311.1

[56] References Cited

U.S. PATENT DOCUMENTS 630,486 8/1899 Caspar ..... 206/412

3,078,795 2/1963 Ritzerfeld et al. ..... 271/1

3,519,124 7/1970 Barker et al. ..... 206/454

*Primary Examiner*—Alexander S. Thomas

*Attorney, Agent, or Firm*—Allston L. Jones; Francis I. Gray

[57] ABSTRACT

A separator for separating adjacent transparencies in a stack of transparencies, where the separator is characterized by enhanced permeability due either to the intrinsic material from which it is made, or due to a plurality of apertures, holes, perforations or the like provided through its surface. In use, the separator adheres to the transparency due to suction created by a vacuum transport mechanism of the reproduction machine such that the transparency and separator move as a unit along a paper path of a reproduction machine.

1 Claim, 12 Drawing Figures

SEPARATOR SHEETS FOR COLLATION WITH A STACK OF TRANSPARENCIES

BACKGROUND OF THE INVENTION

1. Field of the Invention

This invention relates generally to printing paper for reproduction machines, and more particularly to reams of transparencies for such machines.

2. Description of the Prior Art

Many reproduction machines, including copiers and printers, have the capability of copying the indicia from an original paper to a clear plastic sheet. These plastic sheets are known as transparencies, and are usually used with overhead projection machines as visual aids for lectures, conferences, etc.

A problem that is encountered when copying onto transparencies is that adjacent transparencies in a stack of transparencies tend to stick together. Furthermore, after the transparencies are printed upon, the print from one transparency may transfer to the bottom surface of the transparency above it, degrading the projected image.

To avoid these problems, a stack or ream of transparencies is typically provided with separator sheets interleaved with the transparencies. The separator sheets eliminate the sticking and image transference problems, but have, in the past, required complexities to be added to the reproduction machines to handle the separator sheets.

The foremost problems encountered with separator sheets is how to transport them through the reproduction machines without printing on them and without increasing the cycle time per copy. In the past, the separator sheet associated with a transparency was sent through the paper path after the transparency had been printed upon, and a sensing mechanism was used to differentiate between the transparency and the separator so that the separator would not be printed upon. A problem with this solution, however, is that by sending the transparency and the separator through the paper handling path separately, the cycle time of the reproduction machine was substantially increased. Furthermore, the sensing mechanism which determines whether a transparency or a separator is being transported through the machine increases the complexity and cost of the machine.

Some reproduction machines, such as the Tektronix 4692 ink jet copier, utilize a vacuum transport system for moving the transparencies and the separator sheets along the paper path. In the Tektronix 4692, a transparency is held to a rotating drum by a vacuum, and an ink jet mechanism prints the desired indicia on the rotating transparency. In the past, vacuum transport systems suffered from the same problems as any other transport systems in that cycle time was increased and costly sensors were required when transparencies were being copied.

SUMMARY OF THE INVENTION

An object of this invention is to reduce the cycle time required for the reproduction of transparencies.

Another object of this invention is to eliminate the need for costly sensors to differentiate between transparencies and their associated separator sheets.

Briefly, the invention comprises a collated stack consisting of a plurality of permeable separator sheets interleaved with a corresponding number of substantially impermeable transparencies. The separator sheets can be made from a porous material such as filter paper, or may alternatively be provided with a plurality of apertures, holes, or perforations which enhance their permeability. The permeability of the separator sheets allow a separator sheet and a transparency to move through the paper path as a unit in reproduction machines having vacuum transport mechanisms.

Since the transparencies and separators are handled as a unit, the present invention is advantageous in that only one print cycle per transparency is required. The invention is also advantageous in that the costly sensors of the prior art which differentiated between the separator sheets and the transparencies are no longer required.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 1:
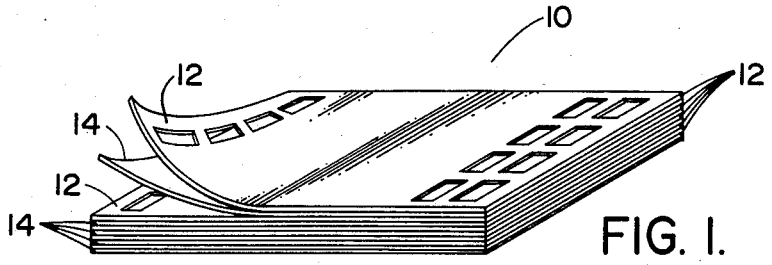
FIG. 1 is a perspective view of a collated stack including alternating transparent sheets and separator sheets in accordance with the present invention.

Referring to FIG. 1, a stack 10 includes alternating sheets of separators 12 and transparencies 14. The process of manufacturing transparencies 14 is well known to those skilled in the art, and includes the cutting of clear, thermoplastic material into $8\frac{1}{2}''\times 11''$, $8\frac{1}{2}''\times 14''$, and other useful sizes. The transparencies 14 are sufficiently thick and dense so as to be substantially impermeable to liquids and gasses, but are sufficiently pliable to be handled by the reproduction machine's paper handling mechanism.

Figure 2A:
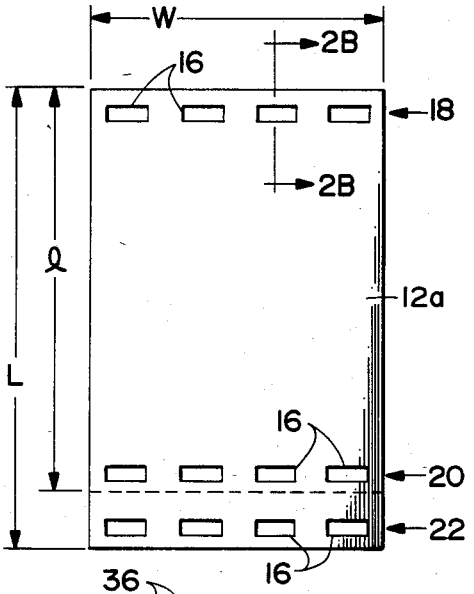
FIG. 2*a* is a top plan view of the collated stack of FIG. 1.

Referring to FIG. 2*a*, a separator 12*a* is a thin, flexible sheet of material, preferably made from a textured paper or the like, which is cut to substantially the same dimensions as the transparency 14 with which it is associated. More particularly, separator 12*a* is usually cut to a width W of 8½ inches, and has a length "L" of 14 inches or a length "l" of 11 inches.

Separator 12 is provided with a plurality of rectangular apertures 16 formed in three rows 18, 20, and 22. If the separator 12*a* were of the shorter length l, it would be provided with only two rows of apertures 16, namely rows 18 and 20.

Figure 2B:
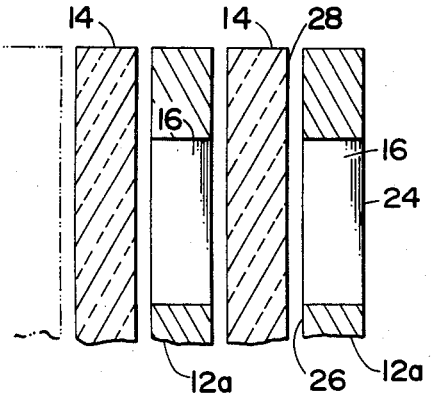
FIG. 2*b* is an enlarged cross-section taken along line 2*b*—2*b* of FIG. 2*a;*

Referring now to FIG. 2*b*, apertures 16 extend between a first side 24 and a second side 26 of separators 12*a* such that any vacuum applied to apertures 16 from the first side 24 would cause the second side 26 to be held against a side 28 of transparency 14. Thus, by applying a vacuum to a separator 12*a*, adjacent transparency/separator pairs will be held together as a unit.

Figure 3A:
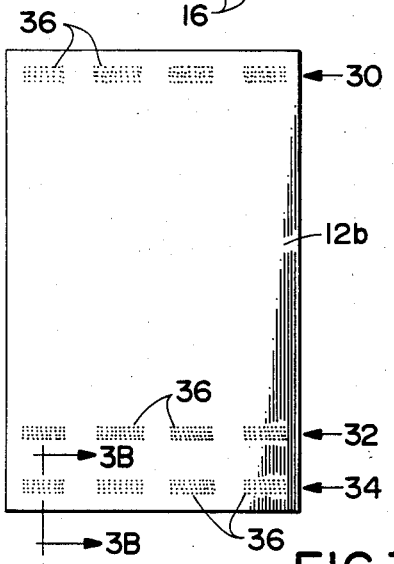
FIG. 3*a* is a top plan view similar to that of FIG. 2*a* of a first alternate embodiment of the present invention.

In FIG. 3*a*, an alternate separator 12*b* is shown having three rows 30, 32, and 34 each having four regions 36 of enhanced permeability. As can be noted in a comparison between FIGS. 2*a* and 3*a*, the regions 36 are formed in the same locations as apertures 16.

Figure 3B:
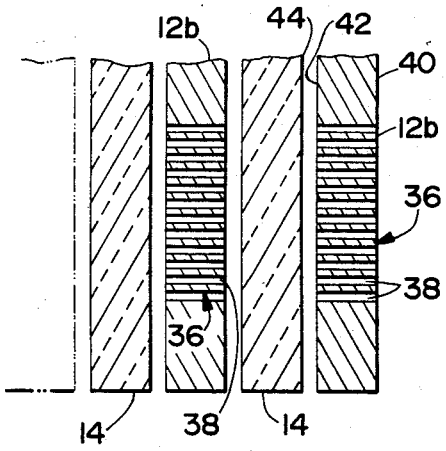
FIG. 3*b* is an enlarged cross-section taken along line 3*b*—3*b* of FIG. 3*a;*

Referring now to FIG. 3*b*, the permeability of regions 36 are enhanced by punching, perforating or otherwise providing a plurality of holes 38 through the separator 12*b*. The holes 38 serve the same function as apertures 16 in FIG. 2*b*, namely to allow vacuum applied to a side 40 of separator 12*b* to hold a side 42 of the separator to a side 44 of transparency 14.

Figure 4A:
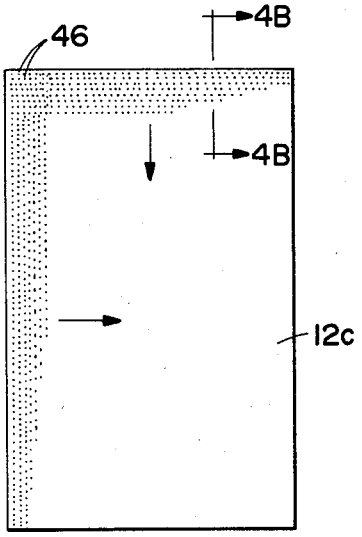
FIG. 4*a* is a top plan view similar to that of FIGS. 2*a* and 3*a* of a second alternate embodiment of the present invention.
Figure 4B:
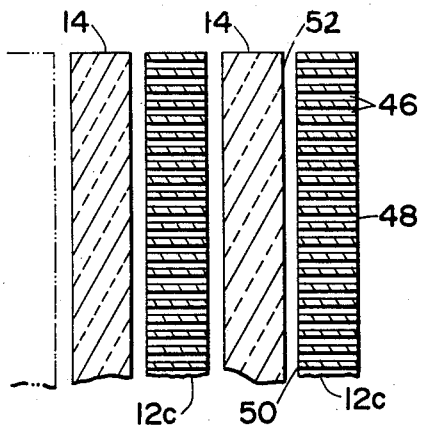
FIG. 4*b* is an enlarged cross-section taken along line 4*b*—4*b* of FIG. 4*a;*

Referring to FIGS. 4*a* and 4*b*, another alternate embodiment for a separator 12*c* is shown wherein the permeability of the separator 12*c* is enhanced by providing a plurality of holes 46 over substantially the entire surface of separator sheet 12*c*. Again, the holes 46 provide a conduit between sides 48 and 50 of separator sheet 12*c* such that a vacuum applied to side 48 will firmly hold side 50 against a side 52 of transparency 14.

Figure 5A:
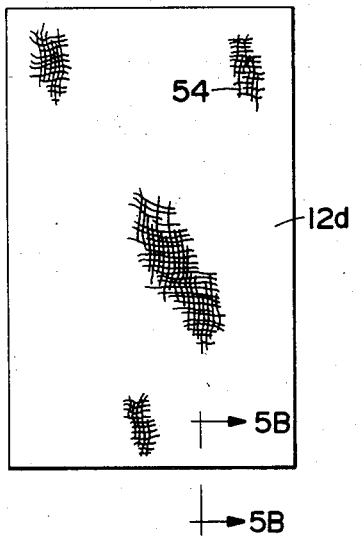
FIG. 5*a* is a top plan view similar to that of FIGS. 2*a*, 3*a*, and 4*a* of a third alternate embodiment of the present invention.
Figure 5B:
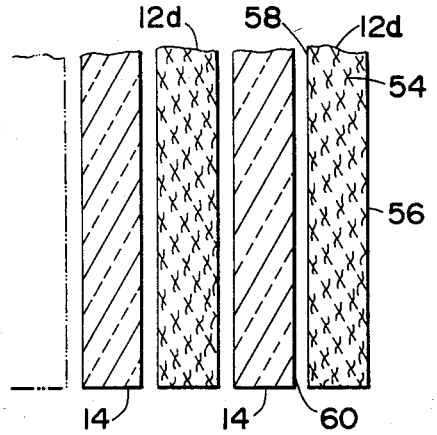
FIG. 5*b* is an enlarged cross-section taken along line 5*b*—5*b* of FIG. 5*a;*

In FIGS. 5*a* and 5*b*, the separator 12*d* is made from a material which inherently permeable, such as filter paper. The fibers 54 are loosely woven such that a vacuum applied to a side 56 of separator 12*d* causes a side 58 thereof to adhere to a side 60 of transparency 14.

Figure 6:
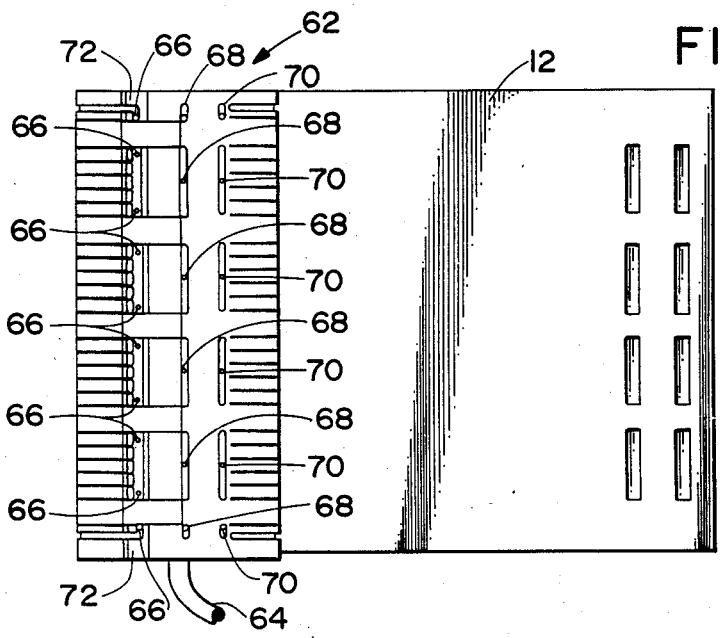
FIG. 6 is a top plan view of the collated stack of FIG. 1 operationally disposed beneath a vacuum operated drum of a reproduction machine.

The operation of the present device will be discussed with reference to FIGS. 6–8. In FIG. 6, a vacuum drum 62 from a Tektronix 4692 ink jet copier is coupled to an appropriate vacuum source by a hose 64. The drum 62 is provided with a plurality of vacuum ports 66 designed to hold a leading edge of a sheet to be printed upon, and the number of vacuum ports 68 and 70 are provided to affix the trailing edge of two different lengths of sheets to the drum 62. A groove 72 is provided on the surface of drum 62 at port 66 to allow the leading edge of the copying paper to be recessed below the circumference of the drum for aerodynamic purposes.

Figure 7:
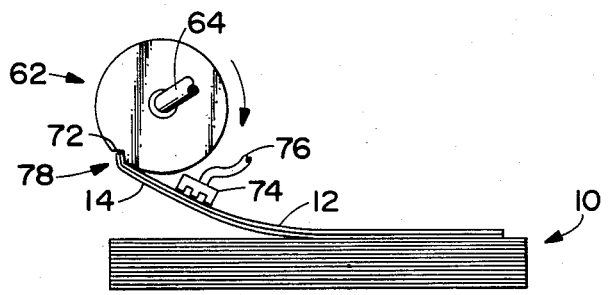
FIG. 7 is a simplified side elevation illustrating a first method for loading a separator sheet and a transparency to the drum of the reproduction machine.

In FIG. 7, a vacuum pick 74 is connected to the vacuum source by a tube 76. Vacuum pick 74 is used to lift a separator sheet 12 and an associated transparency 14 from stack 10 and to insert the leading edge 78 of the separator/transparency pair into groove 72 of drum 62. Since separator 12 is permeable, the vacuum provided by vacuum pick 74, drum 62, and the remainder of the vacuum transport system (not shown) firmly holds separator 12 and transparency 14 together. Because separator 12 is sandwiched between transparency 14 and the circumferential surface of drum 62, only the surface of transparency 14 which is distal from separator 12 will be printed upon.

Figure 8:
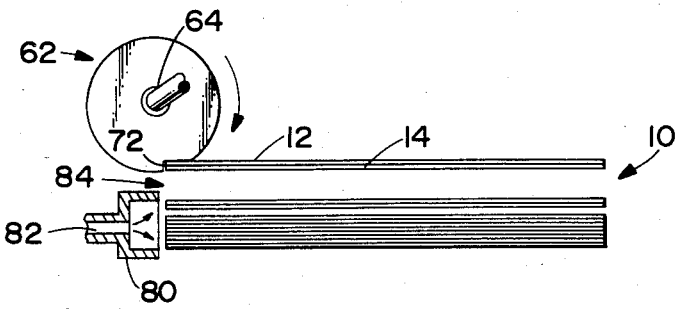
FIG. 8 is a simplified side elevation illustrating a second method for loading a separator sheet and a transparency to the drum of the reproduction machine.

In FIG. 8, a manifold 80 is connected to a blower or other source of pressurized gas by a tube 82. Air blowing from manifold 80 causes a "fluffing" of the leading edges 84 of stack 10, and causes the top few sheets of stack 10 to elevate above the level of the stack. When the leading edges 84 of the top separator/transparency pair engage groove 72 of drum 62, the vacuum at ports 66 cause the separator 12 and transparency 14 to adhere to the drum as a unit.

It should be noted that it does not matter whether a transparency 14 or a separator 12 is on the top of stack 10 at the beginning of the copying cycles. If a transparency is on top of stack 10, then solitary transparency will be transported through the reproduction machine on the first cycle, and subsequent cycles will transport separator/transparency pairs through the machine.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A collated stack for a reproduction machine having a vacuum paper handling mechanism, said collated stack comprising a plurality of substantially impermeable copier sheets made from a transparent thermoplastic material, and a plurality of permeable separator sheets provided with a plurality of holes covering substantially the entire surface area of said separator sheets, said separator sheets being alternately interleaved with said plurality of copier sheets.

* * * * *